United States Patent [19]

Inoue

[11] Patent Number: 4,946,755

[45] Date of Patent: Aug. 7, 1990

[54] ELECTROPHOTOGRAPHIC ONE COMPONENT MAGNETIC TONER COMPRISING HYDROPHOBIC SILICA AND IRON OXIDE

[75] Inventor: Sukejiro Inoue, Yokohama, Japan

[73] Assignee: Canon Kabushiki Kaisha, Tokyo, Japan

[21] Appl. No.: 349,900

[22] Filed: May 8, 1989

Related U.S. Application Data

[63] Continuation of Ser. No. 217,121, Jul. 5, 1988, abandoned, which is a continuation of Ser. No. 902,135, Sep. 2, 1986, abandoned, which is a continuation of Ser. No. 696,895, Jan. 31, 1985, abandoned, which is a continuation of Ser. No. 479,315, Mar. 28, 1983, abandoned.

[30] Foreign Application Priority Data

Apr. 1, 1982 [JP] Japan ..... 57-54382

[51] Int. Cl.[5] ..... G03G 9/14

[52] U.S. Cl. ..... 430/106.6; 430/110; 430/903; 524/901; 526/934; 525/934

[58] Field of Search ..... 430/111, 106.6, 903, 430/110; 524/901

[56] References Cited

U.S. PATENT DOCUMENTS

| | | | |
|---|---|---|---|
| 2,221,776 | 11/1940 | Carlson | 430/31 |
| 2,297,691 | 10/1942 | Carlson | 430/31 |
| 2,618,552 | 11/1952 | Wise | 430/109 |
| 2,874,063 | 2/1959 | Grieg | 430/106 |
| 3,909,258 | 9/1975 | Kotz | 430/31 X |
| 4,111,823 | 9/1978 | Kobayashi | 430/111 X |
| 4,259,426 | 3/1981 | Hasegawa et al. | 430/111 X |
| 4,282,302 | 8/1981 | Makino et al. | 430/107 |
| 4,292,387 | 9/1981 | Kanbe et al. | 430/31 X |

FOREIGN PATENT DOCUMENTS

| | | | |
|---|---|---|---|
| 1165405 | 10/1969 | United Kingdom . | |
| 1165406 | 10/1969 | United Kingdom . | |
| 2040488 | 8/1980 | United Kingdom | 430/903 |

*Primary Examiner*—J. David Welsh

*Attorney, Agent, or Firm*—Fitzpatrick, Cella, Harper & Scinto

[57] ABSTRACT

Disclosed is an electrophotographic magnetic toner comprising 40–80% binder resin, a waxy material such as a low molecular weight polypropylene or polyethylene, a charge control agent and 20–60% iron oxide having a number average particle size of 0.2–0.7 microns and wherein trivalent Fe is present in excess and wherein the iron oxide contains 16–25% FeO and about 75–84% $Fe_2O_3$.

30 Claims, 1 Drawing Sheet

ELECTROPHOTOGRAPHIC ONE COMPONENT MAGNETIC TONER COMPRISING HYDROPHOBIC SILICA AND IRON OXIDE

This application is a continuation of application Ser. No. 217,121 filed July 5, 1988, which was a continuation of application Ser. No. 902,135 filed Sept. 2, 1986, which was a continuation of Ser. No. 696,895 filed Jan. 31, 1985, which was a continuation of Ser. No. 479,315 filed Mar. 28, 1983, each now abandoned.

BACKGROUND OF THE INVENTION

1. Field of the Invention

This invention relates to a toner used for electrophotography, electrostatic recording, and the like, and more particularly, to an insulating magnetic toner.

2. Description of the Prior Art

There are known many electrophotographic processes such as those disclosed in U.S. Pat. No. 2,297,691, British Pat. Nos. 1,165,406 and 1,164,405. Most widely used are processes comprising utilizing a photoconductive material, forming electric latent image on a photosensitive material by an optional means, developing the latent images with a toner, if desired, transferring the images thus developed to an image receiving member such as a paper, and then fixing the developed toner images by heat, pressure, solvent vapor or the like. There are known various methods for visualizing electric latent images by a toner. For example, there are known magnetic brush methods as disclosed in U.S. Pat. No. 2,874,063, cascade developing methods as disclosed in U.S. Pat. No. 2,618,552, powder cloud methods as disclosed in U.S. No. 2,221,776, fur brush methods, liquid developing methods and the like.

Among these developing methods, there are widely used, in practice, magnetic brush methods, cascade methods, liquid developing methods and the like where the developer is mainly composed of toner and a carrier. These developing methods can produce relatively stably a good image, but suffer from degradation of carrier and variation of the mixing ratio of the toner and the carrier which are common and inherent drawbacks of two-component developers.

For the purpose of avoiding such drawbacks, it has been proposed to use one-component developers composed of toner only, and among them, methods using a developer composed of magnetic toner particles give a good result.

U.S. Pat. No. 3,909,258 disclosed a process for developing with a magnetically attractable, electronically conductive toner where a developer composed of the toner is carried on a conductive sleeve of drum type having magnets inside and the development is carried out by contacting the developer with electrostatic images. At the developing portion an electrically conductive path is formed by the toner particle between the surface of an image receiving member and the sleeve surface, and electric charge is led from the sleeve to the toner particles through the electronically conductive path, and the toner particles attach to the image portions by Coulomb force to develop the image portions.

The above mentioned development method using the magnetically attractable, electronically conductive toner is a good method free from inherent problems of twocomponent developing methods, but it is difficult to transfer electrostatically the developed images to a final support such as plain paper from the development image bearing member because the toner is electrically conductive.

As a developing method where a highly resistive and magnetic toner capable of being transferred electrostatically is employed, Japanese Patent Laid-Open No. 94140/1977 discloses a process for development utilizing induction polarization of toner particles, but the process suffers from disadvantages such as low development speed and insufficient density of the development images, and is practiced with difficulty.

A further method of development using a highly resistive and magnetic toner is a method comprising triboelectrically charging the toner particles by the friction of toner particles contacting each other, the friction between toner particles and a sleeve, and the like, and bringing the toner particles thus charged into contact with an electrostatic image bearing member to develop the electrostatic images. However, this method suffers from the disadvantages that the amount of contact between the toner particles and the friction member is too small to be sufficiently charged and the toner particles thus charged are more strongly affected by Coulomb force between the toner particles and the sleeve and thereby are liable to agglomerate on the sleeve. The practical operation is effected with difficulty.

Meanwhile, U.S. Pat. No. 4,292,387 proposed a novel development method overcoming the above-mentioned disadvantages. In this method, an extremely thin layer of a magnetic toner is formed on a sleeve, charged triboelectrically, and in a magnetic field, is brought very closely to an electrostatic image to face each other without contact, thus developing the image. According to this method, the extremely thin layer of toner increases the opportunity of toner-sleeve contact, thereby permitting generation of a sufficient amount of triboelectricity; the toner is held on the sleeve by the action of magnets contained therein and is moved in relation to the magnets, thereby rubbing sufficiently the toner with the sleeve as well as deagglomerating aggregates of toner particles; and background fogging is prevented by developing the electrostatic image with the toner which is held by the magnetic force and opposed to the image without contact; whereby an excellent image can be obtained. However, since the insulating toner used in this development method contains a considerable amount of a finely divided magnetic material dispersed in a binder resin, and a part of the magnetic material is found on the surface of the toner particles, the dispersion degree of the magnetic material in the binder resin has a great influence on the free flow and triboelectric property of the magnetic toner, thus affecting the variation and deterioration of development characteristics, durablity, and other properties of the toner. The dispersion degree of the magnetic material in the binder resin in the mixing and kneading steps of the toner production process intimately relates to the dispersion degree in the particles of the final product toner, thus affecting performance characteristics of the toner to a large extent. Moreover, under high humidity service conditions or other unfavorable conditions, the toner exhibits poor free flow and hence tends to form aggregates, which can not be throughly deagglomerated by magnetic force, and the triboelectric charging of the toner becomes insufficient, thus deteriorating the quality and density of image. As stated above this improved development method involves unstable factors concerning characteristics of the magnetic material and is liable to be affected by environmental conditions.

Known magnetic powders used for magnetic toners are ferromagnetic elements and alloys and compounds thereof, including those containing iron, cobalt, nickel, manganese, or zinc such as magnetite, maghemite, ferrite, and the like. Properties known to be required for magnetic powders of these materials are, for example, (1) maximum magnetizing force $\sigma m$ of at least about 40 emu/g, (2) coercive force Hc of about 150–500 Oe, (3) electric resistivity of $10^2$–$10^7$ $\Omega$·cm, (4) sufficient blackness for practical use, (5) good humidity resistance, and (6) good miscibility for resin. Magnetic toners are made in many cases from magnetite which is widely used as a pigment called "iron black" and magnetite is after mentioned in various patents of the prior art. Magnetite almost fulfills the above-mentioned requirements, but in order to use it for an insulating magnetic toner, sufficient examinations are necessary on the miscibility of magnetite with resin and the toner agglomeration tendency, triboelectric chargeability, and durability.

SUMMARY OF THE INVENTION

An object of this invention is to provide an insulating magnetic toner free from the foregoing drawbacks.

Another object of this invention is to provide an insulating magnetic toner which has a good and stable chargeability irrespective of temperature and humidity during service and gives clear images without causing fogging.

A further object of this invention is to provide an insulating magnetic toner which exhibits a high free flow and does not agglomerate.

Still another object of this invention is to provide a one-component insulating magnetic toner with which electrostatic images can be developed easily and very efficiently without using any special means such as a corona discharging mechanism and the like, and the magnetic brush of which does not give excessive attrition to the photosensitive member surface.

This invention provides an electrostatic-image-developing magnetic toner comprising at least a magnetic powder and a binder resin, said magnetic powder being a magnetite which contains 16–25 % by weight of FeO. Said magnetic toner contains desirably 20–60% by weight of said magnetic powder. Further, it is desirable that said magnetic powder has a number average particle size of 0.2–0.7$\mu$ and a specific surface area of 2–10 $m^2/g$.

DESCRIPTION OF THE PREFERRED EMBODIMENTS

Figure 1:
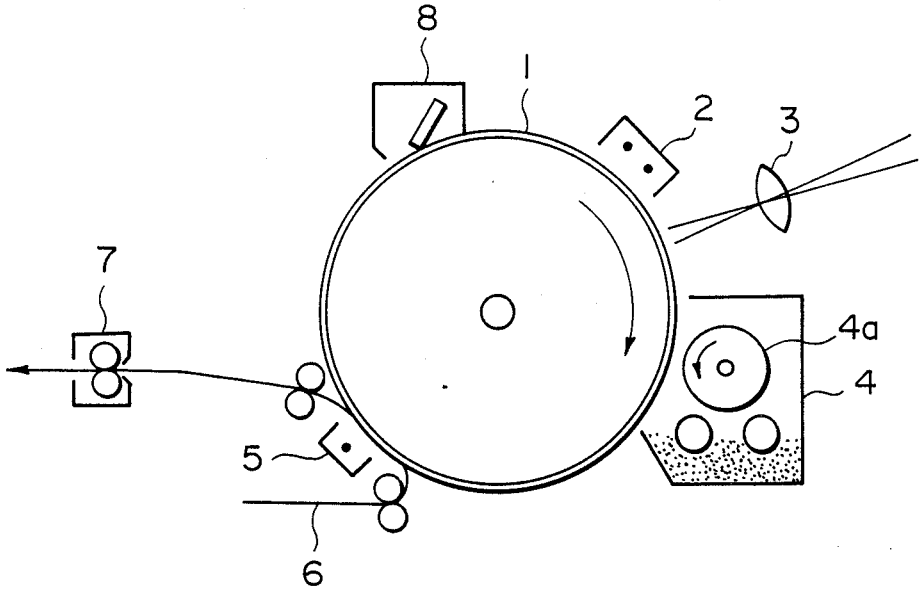

When an electrostatic image formed on a photosensitive member is developed in an alternating or bias electric field with a one-component magnetic toner supported magnetically and opposed to the electrostatic image without contact, the individual toner particles are subjected to Coulomb force between the toner particles and the electrostatic image, magnetic force between the toner particles and a magnetic brush forming magnet, a force due to the alternating electric field and the like. The particles in which the Coulomb force is greater than the magnetic counterforce are attracted to the electrostatic image, while those in which the magnetic counterforce is greater than the Coulomb force are attracted to the development sleeve.

When the magnetic toner image developed on the photosensitive member is transferred onto transfer paper, the toner image is pulled onto the transfer paper by generating a corona discharge opposite in polarity to the magnetic toner, viz. the same in polarity as the electrostatic image, on the back side of the transfer paper. In this case, electric charge on the toner particles, if ready to leak and dissipate, will cause a distortion of the transferred image or a drop in transfer efficiency. Accordingly, the magnetic toner particles intensely requested to have a property of holding stably electric charge on the magnetic powders since magnetic toner contains a relatively large amount of magnetic powders as a constituting component.

Studies by the present inventor of magnetite, ferrite, and the like particularly in consideration of means of controlling properties of insulating magnetic toners have revealed that satisfactory images can be obtained constantly in high efficiencies of developing electrostatic images and of transferring the developed images, with a magnetic toner prepared by uniform dispersion, in a resin, of a magnetic iron oxide having an oxidation degree lying in a definite range.

The magnetic powder used in this invention is a black iron oxide conventionally used in the art, which is a kind of tri-iron tetraoxide generally called magnetite. Black iron oxide considerably varies its own properties such as particle size, shape, blackness, color tone, apparent density, oil absorption and the like as well as magnetic properties, depending upon operational conditions in its production process. Properties of the magnetic toner containing the black iron oxide are affected by these variations. The blackness of the black iron oxide powder depends upon the FeO content therein and the average particle size thereof. Its color adds a red-brown shade as the FeO content decreases below 10% by weight. The blackness lowers with a decrease in its particle size. The black magnetic iron oxide conventionally used for one-component magnetic toners is tri-iron tetraoxide and contains approximately 26–34% by weight of FeO, while the one produced by the wet production process contains approximately 26–28% by weight of FeO in many cases. Although theoretical FeO content in proper tri-iron tetraoxide is 31.3% by weight, a slight extent of its oxidation is inevitable in the wet production process and hence the $Fe^{III}$ content tends to become excess. Tri-iron tetraoxide powders have generally a number average particle size of about 0.1–0.3$\mu$. However, when using, according to this invention, a black magnetic iron oxide of FeO content 16–25% by weight, number average particle size 0.2–0.7$\mu$, and specific surface area 2–10 $m^2/g$, it is possible to obtain an excellent magnetic toner which, as will be stated later, improves markedly transferred images as compared with the toners made from the conventional black magnetic iron oxide, gives images good in qualities such as reproducibility of half tone, and is superior in long term stability and environmental-humidity independency. The cause of this, though not yet clarified satisfactorily, seems to relate intimately to the fact that the magnetic powder of this invention has high powder flow and exhibits good dispersibility in the resin in the production of the toner.

The magnetic powder having such properties is available as a cubic crystal form or slightly round amorphous from of tri-iron tetraoxide that has coarse particle sizes and was treated in the production process so as to force its oxidation to some extent. A nearly needle crystal form of tri-iron tetraoxide is also utilizable satisfactorily provided that its axial ratio (long axis/short axis) is up to about 5.

Such a black magnetic iron oxide of this invention is produced in the following way: A solution of ferrous sulfate hepta hydrate in distilled water is placed in a reaction vessel, which is then stoppered and purged with nitrogen gas to prevent the oxidation. The solution is heated to 60° C., and 6N aqueous sodium hydroxide is added up to the neutral point. After iron hydroxide has been separated out by this neutralization, air is bubbled into the suspension for 24 hours to give a precipitate of tri-iron tetraoxide in cubic crystal from, which is then filtered and dried.

Black iron oxide particles of various particle size can be obtained by conducting this tri-iron tetraoxide production process under various controlled conditions. In addition, those of various FeO contents can be obtained by conducting said filtration and drying under various controlled conditions. The particle size of the product generally increases with an increase in the pH of the mother liquor, an increase in the oxidation temperature, and a decrease in the flow of the bubbling air. The FeO content in the iron oxide obtained by this process is mostly 27–28% by weight after drying. In the conventional process, the iron oxide dried is subjected to a reduction treatment, for example, a treatment with a stream of hydrogen at about 400° C. in a reduction furnace, so as to give a $Fe^{II}/Fe^{III}$ ratio of 0.45–0.55 (FeO content of 29–33% by weight). According to this invention, said iron oxide is subjected to an oxidation treatment as required, so as to give a FeO content of 16–25% by weight.

Another process for producing the black magnetic iron oxide of this invention is as follows: An aqueous sodium hydroxide is added to an aqueous solution of ferrous sulfate to precipitate ferric hydroxide. The precipitate is subjected to a pressurized hydrothermal treatment at a pH of 4–10 of the mother liquor to convert the colloidal precipitate of iron hydroxide into a cubic crystal form of $\alpha$-$Fe_2O_3$, which is then subjected to a reduction treatment to give a cubic crystal form of tri-iron tetraoxide. Also in this process, a product of a predetermined particle size and oxidation degree can be obtained by proper choosing of the pH of the mother liquor, treatment temperature, and treatment period.

Besides the black iron oxides produced by said wet process or wet and dry process, those produced by a dry process via. an $\alpha$-$Fe_2O_3$ prepared by a dry process can also be utilized in this invention. Reduction of the $\alpha$-$Fe_2O_3$ can be carried out as follows $\alpha$-$Fe_2O_3$ is placed in a furnace and sintered under the conditions of heating rate 200° C./hr. sintering temperature 1350° C., sintering period 3 hours, and cooling rate 300° C./hr. In this operation, the oxygen content is the surrounding atmosphere is controlled as follows: 21 vol % during heating up to 900° C. and 5 vol % from 900° to 1350° C.; 1.5 vol % during sintering at 1350° C.; 0.3 vol % during cooling from 1350° to 1100° C. and 0.01 vol % from 1100° to 150° C. After cooling to room temperature, the sintered product is taken out from the furnace, crushed coarsely, and pulverized in an atomizer to particle sizes of 150 mesh and less. Then, the resulting powder is ground in a wet type of attritor for 30 hours. After filtration of the resulting slurry, the filter cake is dried and deagglomerated by means of an atomizer. Thus, a magnetite powder is obtained.

The FeO content in the magnetic powder is determined by $KMnO_4$ titration as follow: A sample of magnetic powder (0.500 g) is weighed out and added to 20 ml of 6N HCl contained in a 500-ml flask while passing $CO_2$ gas. After dissolution of the sample by heating, the solution is cooled to room temperature while passing $CO_2$ gas, and then 20 ml of $MnSO_4$ mixture and about 200 ml of water are added. The mixture is titrated with 0.1N $KMnO_4$. The end point is where the solution becomes faintly red with $MnO_4$ ions. Parallel to this titration, a blank titration is carried out. The FeO content (wt. %) is calculated according to the equation $$\text{FeO (wt \%)} = \frac{\left[\begin{array}{c}\text{FeO weight (g) equivalent}\\ \text{to 1 ml of 0.1N } KMnO_4\end{array}\right] \times [\text{sample titer (ml)} - \text{blank titer (ml)}]}{\text{weight of sample (g)}} \times 100$$

Black magnetic iron oxide powders used in this invention have a coercive force (Hc) desirably up to 300 Oe, preferably up to 200 Oe, and a saturated magnetizing force ($\sigma$s) desirably of 60 emu/g or more.

The magnetic powder content in the toner is desirably 20–60%, preferably 25–50%, by weight.

Binder resins for use in the present toner include homopolymers and copolymers of styrene and substitution products thereof such as polystyrene, poly (p-chlorostyrene), polyvinyltoluene, styrene-p-chlorostyrene copolymer, styrene-vinyltoluene copolymer, and the like; copolymers of styrene with acrylic acid ester such as styrene-methyl acrylate, styrene-ethyl acrylate, and styrene-n-butyl acrylate copolymers and the like; copolymers of styrene with methacrylic acid ester such as styrene-methyl methacrylate, styrene-ethyl methacrylate, and styrene-n-butyl methacrylate copolymers and the like; multipolymers of styrene, acrylic acid ester, and methacrylic ester; other styrene-vinyl type monomer copolymers such as styrene-acrylonitrile, styrene-vinyl methyl ether, styrene-butadiene, styrene-vinyl methyl ketone, styrene-acrylonitrile-indene, and styrene-maleic acid ester copolymers and the like; poly (methyl methacrylate), poly (butyl methacrylate), poly (vinyl acetate), polyesters, polyamides, epoxy resins, poly (vinyl butyral), poly (acrylic acid), phenolic resins, aliphatic or alicyclic hydrocarbon resins, petroleum resins, chlorinated parafin, etc. These can be used alone or in combination.

Binder resins for the toner used in the pressure fixing system include low molecular weight polyethylene, low molecular weight polypropylene, ethylene-vinyl acetate copolymer, ethylene-acrylic acid ester copolymers, higher fatty acids, polyamide resins, polyester resins, etc. These can be used alone or in combination.

Preferably, homopolymers, copolymers, and polymer blends used for the present toner contain at least 40% by weight of an aromatic vinyl monomer, its typical example being styrene, or of an acrylic monomer. With such a binder resin, favorable results can be obtained.

In this invention, the content of the above-cited binder resin in the magnetic toner is 40–80% by weight. If the binder resin content is less than 40% by weight, electric properties and fixability of the magnetic toner are poor. If the content exceeds 80% by weight, that is, the content of magnetic powder decreases correspondingly, magnetic properties of the toner become defective, resulting in unsatisfactory ability to be carried by the sleeve and poor developing properties.

The magnetic toner of this invention may contain, if necessary, an electric-charge controller, colorant, or free-flow improver in the particles; The electric-charge controller and the free-flow improver can also be used to mix with the toner particles (these additives adhere to the outside of the particles). Metal complex dyes and nigrosine can be used as the electric-charge controller; known dyes and pigments as the colorant; and colloidal silica, metal salts of fatty acids, etc. as the free-flow improver.

For the purpose of extending, a filler such as calcium carbonate, finely divided silica, or the like can be mixed in the magnetic toner in an amount of 0.5–20% by weight based on the magnetic toner. Additionally, a free-flow improver such as a fine powder of Teflon may be compounded for the purpose of improving the free flow by preventing the agglomeration of toner particles with one another. Moreover, for the purpose of improving the releasability in the heat-roll fixing operation, there may be added about 0.5–5% by weight (based on the magnetic toner) of a waxy material such as low molecular weight polyethylene, low molecular weight polypropylene, microcrystalline wax, carnauba wax, Sazol wax, and the like.

Various methods can be applied to the preparation of the present toner particles; for instance, a method comprising kneading necessary component materials by means of a heat mixer such as a heat roll mill, kneader, extruder, or the like, followed by mechanical grinding and then classification; a method comprising dispersing a magnetic powder and other necessary materials in a solution of a binder resin, followed by spray drying; and a polymerization-involving method comprising admixing a magnetic powder and other necessary materials with a monomer which is to form a binder resin, followed by polymerization of the resulting slurry.

This invention is illustrated in more detail with reference to the following Examples wherein parts are all by weight.

EXAMPLE 1

A black magnetic iron oxide (60 parts) in cubic crystal form which contained 20 wt. % of FeO and had a number-average particle size of 0.4μ and a specific surface area of 4 $m^2/g$ (hereinafter, this iron oxide is simply referred to as magnetite), styrene-butyl acrylate copolymer (100 parts, monomer weight ratio 75/25, number average molecular weight 200,000), low molecular weight polypropylene (4 parts of Viscol 550-P, supplied by Sanyo Chem. Ind., Ltd.), negative-charge controller (4 parts of Bontron S-31, a type of metal complex dye supplied by Orient Chem. Ind., Ltd.) were melt-mixed by means of a roll mill. After colling, the mixture was coarsely crushed in a cutter mill to particle sizes of 2 mm or less, and was finely pulverized by means of an air jet mill. The reasulting powder was classified by means of a zigzag classifier to give a magnetic toner of 3–20μ in particle size.

A hydrophobic silica (R - 972, supplied by Nihon Aerosil Co., Ltd.) was added as a free-flow improver to the resulting toner. The developer thus obtained was fed to the development unit of a copying machine (NP-400RE, mfd, by Canon K. K.) which employs a CdS/resin layer as a photosensitive member, and its copying tests were made under ordinary copying conditions (clearance between development sleeve and photosensitive member 250μ, development bias D.C. fraction 100 V, overlapped A.C. bias 1000 Hz, 1300 Vp-p). As a result, this developer gave good image quality, in particular sufficient in initial image density and resolution, and exhibited a good anti-scattering property during transferring. Further, a test duplicating 10,000 copies made on this developer for evaluating its durability in repeated development operations. No particular irregularity occurred in images during the test including developer supplementing operations.

EXAMPLES 2 AND 3 AND COMPARATIVE EXAMPLES 1 AND 2

Magnetic toners were prepared and tested in the same manner as in Example 1 except for using different kinds of magnetite as shown in Table 1. Results are summarized in Table 2.

TABLE 1

| | Components used | | | | | |
|---|---|---|---|---|---|---|
| | Magnetite (60 parts) | | | | | |
| | FeO wt % | Number average particle size (μ) | Specific surface area ($m^2/g$) | Binder resin (100 parts) | Low molecular weight polypropylene (4 parts) | Electric-charge controller (4 parts) |
| Example 1 | 20 | 0.4 | 4 | Styrene-Butyl acrylate copolymer | Viscol 550P | Bontron S-31 |
| Example 2 | 23 | 0.3 | 6 | Styrene-Butyl acrylate copolymer | Viscol 550P | Bontron S-31 |
| Example 3 | 18 | 0.45 | 3.3 | Styrene-Butyl acrylate copolymer | Viscol 550P | Bontron S-31 |
| Comparative Example 1 | 28 | 0.4 | 4.5 | Styrene-Butyl acrylate copolymer | Viscol 550P | Bontron S-31 |
| Comparative Example 2 | 26 | 0.1 | 12.0 | Styrene-Butyl acrylate copolymer | Viscol 550P | Bontron S-31 |

TABLE 2

| | Number average particle size of tonter | Quantity of tribo-electricity | Image density | Anti-scattering property of toner particles | Uniformity of full-face blacking | Development durability |
|---|---|---|---|---|---|---|
| Example | 10.4μ | 17.5μc/g | 1.15 | ◎ | ○ | ○ |
| Example 2 | 11.5 | 16.6 | 1.21 | ◎ | ◎ | ○ |
| Example 3 | 11.0 | 18.0 | 1.18 | ◎ | ○ | ○ |
| Comparative Example 1 | 10.8 | 14.7 | 0.95 | Δ | Δ | Δ |
| Comparative Example 2 | 10.2 | 14.1 | 0.86 | ○ | ΔX | Δ |

The signs in Table 2 and Table 4 (infra) have the following meanings:
◎. . . Excellent
○. . . Good
○Δ . . . Practically usable
Δ . . . Poor
ΔX . . . Bad

EXAMPLES 4–6 AND COMPARATIVE EXAMPLES 3 AND 4

Magnetic toners were prepared and tested in the same manner as in Example 1 except for replacing the magnetic powder and other materials by those shown in Table 3. Results are summarized in Table 4

TABLE 3

| | Magnetite | | | | | | |
|---|---|---|---|---|---|---|---|
| | FeO wt % | Number average particle size (μ) | Specific surface area ($m^2/g$) | Amount mixed (parts) | Binder reins | Releasing agent (4 parts) | Electric-charge controller (4 parts) |
| Example 4 | 24.5 | 0.46 | 2.8 | 60 | Polyester resin | Viscol 550P(d) | Bontron S-31 |
| Example 5 | 20 | 0.4 | 4.0 | 60 | Styrene-butyl methacrylate copolymer(a) | Hiwax 200P(e) | Bontron S-31 |
| Example 6 | 22.3 | 0.65 | 2.2 | 50 | Styrene-2-ethyl-hexyl acrylate -butyl metha acrylate copolymer(b) | Viscol 500P | Bontron S-31 |
| Comparative Example 3 | 27 | 0.42 | 3.1 | 60 | Styrene-butyl acrylate copolymer(c) | Viscol 500P | Bontron S-31 |
| Comparative Example 4 | 24 | 0.15 | 10.8 | 70 | Styrene-butyl acrylate copolymer(c) | Viscol 500P | Bontron S-31 |

Note (a): Monomer ratio=70/30, Mw=280,000
Note (b): Monomer ratio=80/15/5, Mw=360,000
Note (c): Monomer ratio=76/24, Mw=250,000
Note (d) Low molecular weight polypropylene
Note (e) Low molecular weight polyethylene

TABLE 4

| | Image density | Anti-scattering property of toner particles | Uniformity of full-face blacking | Development durability |
|---|---|---|---|---|
| Example 4 | 1.19 | ○ | ○ | ○Δ |
| Example 5 | 1.23 | ○ | ◎ | ○ |
| Example 6 | 1.17 | ◎ | ○ | ○ |
| Comparative Example 3 | 0.92 | ○ | ΔX | Δ |
| Comparative Example | 0.81 | ○ | Δ | Δ |

TABLE 4-continued

| | Image density | Anti-scattering property of toner particles | Uniformity of full-face blacking | Development durability |
|---|---|---|---|---|
| 4 | | | | |

EXAMPLE 7

A magnetite (60 parts of the same magnetite as used in Example 1), low molecular weight polyethylene (100 parts of Hiwax 200P, supplied by Mitsui petrochem. Ind., Ltd.), negative-charge controller (4 parts of Bontron S-31, supplied by Orient Chem. Ind., Ltd.) were melt-mixed by means of a roll mill, and then allowed to cool. The resulting product was finely pulverizied by means of an air jet mill. The resulting powder was classified by means of a zigzag classifier to give a magnetic toner of 3–20μ in particle size. A hydrophobic silica was added, as a free-flow improver, to the resulting toner. The magnetic toner thus produced was fed to the development unit of a commercially available copying machine (NP-120, mfd. by Canon K. K.) to effect copying tests under ordinary copying conditions. As a result, this developer gave good initial image quality, good anti-scattering property during transferring, and good resolution. Further, a copying durability test by duplicating 10,000 copies was made on this developer and no particular irregularity occurred in images during the test including developer supplementing operations.

What I claim is:

1. A one component magnetic developer comprising:
(i) a magnetic toner, said magnetic toner comprising:
(a) a binder resin, said binder resin selected from the group consisting of a copolymer of styrene and acrylic acid ester, a copolymer of styrene and methacrylic acid ester and polyester resin, said binder resin being contained in an amount of 40–80 % by weight based on the total weight of the magnetic toner,
(b) a low molecular weight polypropylene or low molecular weight polyethylene,
(c) a metal complex dye or nigrosine, and
(d) a magnetic powder having a number average particle size 0.2–0.7 microns, said magnetic powder consisting essentially of iron oxide having an excess $Fe^{III}$ content in said magnetic powder, said iron oxide containing 16–25% by weight FeO and about 75–84% by weight of $Fe_2O_3$, based on the iron oxide, said magnetic powder being contained in an amount of 20–60% by weight based on the total weight of said magnetic toner, and
(ii) a hydrophobic silica.

2. The magnetic toner of claim 1, wherein the specific surface area of the magnetic powder is 2–10 $m^2/g$.

3. The magnetic toner of claim 1, wherein the coercive force (Hc) is up to 300 oersteds.

4. The magnetic toner of claim 1, wherein the saturated magnetizing force ($\sigma s$) is at least 60 emu/g.

5. The magnetic toner of claim 1, wherein the magnetic powder is prepared by neutralizing a ferrous sulfate solution and filtering and drying the resulting cubic crystal form of tri-iron tetraoxide.

6. The magnetic toner of claim 5, wherein the magnetic powder is prepared by oxidizing treatment of the tri-iron tetraoxide after said filtration and drying.

7. The magnetic toner of claim 1, wherein the magnetic powder is prepared by neutralizing a ferrous sulfate solution, and subjecting the resulting colloidal precipitate to a pressurized hydrothermal treatment at a pH of the mother liquor of 4–10 to convert the precipitate into a cubic crystal-like $\alpha$-$Fe_2O_3$, followed by a reducing treatment of the resulting $\alpha$-$Fe_2O_3$.

8. The magnetic toner of claim 1, wherein the magnetic powder contains from 18–24.5% by weight of FeO.

9. The magnetic toner of claim 1, wherein the magnetic powder containing 16–25% by weight of FeO is prepared by oxidizing a magnetite powder containing 26–34% by weight of FeO.

10. The magnetic toner of claim 1 wherein the binder resin is contained in an amount of 40–80% by weight, the waxy material is contained in an amount of 0.5–5% by weight and the magnetic powder is contained in an amount of 20–60% by weight, based on the total weight of the magnetic toner.

11. The magnetic toner of claim 10, wherein the magnetic powder has a coercive force (Hc) up to 300 oersteds.

12. The magnetic toner of claim 10, wherein the magnetic powder is prepared by oxidizing a magnetic powder containing 26–34% by weight of FeO.

13. The magnetic toner according to claim 1, wherein the magnetic powder comprises oxidized magnetite.

14. The magnetic toner of claim 13, wherein the specific surface area of the magnetite powder is 2–10 $m^2/g$.

15. The magnetic toner of claim 13, wherein the coercive force (Hc) is up to 300 oersteds.

16. The magnetic toner of claim 13, wherein the mangetite powder is prepared by neutralizing a ferrous sulfate solution to obtain cubic crystal triiron tetroxide and by filtering and drying the triiron tetraoxide.

17. The magnetic toner of claim 16, wherein the magnetite powder is prepared by oxidizing the filtered triiron tetraoxide.

18. The magnetic toner of claim 13, wherein the magnetite powder is prepared by neutralizing a ferrous sulfate solution to obtain a colloidal precipitate in a mother liquor, by subjecting the colloidal precipitate to a pressurized hydrothermal treatment at a mother liquor pH of about 4–10 to convert the precipitate into a cubic crystal-like $\alpha$-$Fe_2O_3$ and by then reducing the $\alpha$-$Fe_2O_3$.

19. The magnetic toner of claim 13, wherein the magnetite powder contains 18–24.5% by weight of FeO.

20. The magnetic toner of claim 13, wherein the magnetite powder containing 16–25% by weight of FeO is prepared by oxidizing a magnetite powder containing 26–34% by weight of FeO.

21. The magnetic toner of claim 20, wherein the binder is contained in an amount of 40–80% by weight, the waxy material is contained in an amount of 0.5–5% by weight and the magnetite powder is contained in an amount of 20–60% by weight, based on the total weight of the magnetic toner.

22. The magnetic toner of claim 21, wherein the magnetite powder has a coercive force (Hc) up to 300 oersteds.

23. The magnetic toner of claim 21, wherein the magnetite is prepared by oxidizing a magnetic powder containing 26–34% by weight of FeO.

24. A one component magnetic developer comprising:
(A) a magnetic toner comprising:
(a) a binder resin, said binder resin selected from the group consisting of a copolymer of styrene and acrylic acid ester, a copolymer of styrene and methacrylic acid ester and a polyester resin, said binder resin being contained in an amount of 40–80% by weight based on the total weight of the magnetic toner,
(b) a low molecular weight polypropylene or low molecular weight polyethylene,
(c) a metal complex dye or nigrosine, and
(d) an oxidized magnetic powder uniformly dispersed in the binder resin, said oxidized magnetic powder consisting essentially of iron oxide having
(i) an excess $Fe^{III}$ content in said magnetic powder;
(ii) a weight ratio of $Fe_2O_3$ to FeO from 3:1 to 5.25:1;
(iii) a number average particle size of 0.2–0.7 microns, and
(iv) a coercive force (Hc) of up to 300 oersteds, said magnetic powder being contained in an amount of 20–60% by weight based on the total weight of the magnetic toner; and
(B) a hydrophobic silica.

25. The magnetic toner of claim 24 wherein the binder resin is present in amounts from 40 to 80% by weight, the waxy material is present in amounts from 0.5 to 5% by weight and the magnetic powder is present in amounts from 20% to 60% by weight, based on the total weight of the magnetic toner.

26. The magnetic toner of claim 24 which includes a free-flow improver.

27. The magnetic toner of claim 26 wherein the free flow improver is a hydrophobic silica.

28. In the process of forming a toner image, comprising the step of: utilizing a photosensitive material, forming an electric latent image on the photosensitive material, developing the latent image with a developer in a field of A.C. bias and D.C. bias to obtain a toner image, transferring the toner image to an image receiving layer and fixing the transferred toner image, the improvement comprising employing as the developer a one component magnetic developer comprising:

(i) a magnetic toner comprising:

(a) a binder resin, said binder resin selected from the group consisting of a copolymer of styrene and acrylic acid ester, a copolymer of styrene and methacrylic acid ester and a polyester resin, said binder resin being contained in an amount of 40–80% weight based on the total weight of the magnetic toner, (b) a low molecular weight polypropylene or low molecular weight polyethylene;

(c) a metal complex dye or nigrosine, and (d) a magnetic powder having a number average particle size of 0.2–0.7 microns, said magnetic powder consisting essentially of iron oxide having an excess $Fe^{III}$ content in said magnetic powder, said iron oxide containing 16–25% by weight of FeO and about 75–84% by weight of $Fe_2O_3$, based on the iron oxide, said magnetic powder being contained in an amount of 20–60% by weight based on the total weight of the magnetic toner; and (ii) a hydrophobic silica.

29. The process according to claim 28, wherein the magnetic toner is supported on a sleeve and is carried in the form of a thin layer while being triboelectrically charged.

30. The process according to claim 29, wherein the thin layer of the magnetic toner on the sleeve is not brought into contact with the photosensitive material.

* * * * *

UNITED STATES PATENT AND TRADEMARK OFFICE

CERTIFICATE OF CORRECTION

PATENT NO. : 4,946,755

DATED : August 7, 1990

INVENTOR(S) : Sukejiro Inoue

It is certified that error appears in the above-identified patent and that said Letters Patent is hereby corrected as shown below:

IN [54] TITLE (ON THE TITLE PAGE)

"TONER" should read --DEVELOPER-- and "AND" should read --AND TONER CONTAINING--.

FIG. 1

Delete Figure 1.

COLUMN 1

Line 3, "TONER" should read --DEVELOPER--.
Line 4, "AND IRON" should read --AND TONER CONTAINING IRON--.
Line 66, "twocomponent" should read --two-component--.

COLUMN 4

Line 65, "from" should read --form--.

COLUMN 5

Line 50, "follows" should read --follows:--.
Line 54, "is" should read --in--.

COLUMN 6

Line 45, "parafin," should read --paraffin,--.

COLUMN 7

Line 1, "particles;" should read --particles.--.

UNITED STATES PATENT AND TRADEMARK OFFICE

CERTIFICATE OF CORRECTION

PATENT NO. : 4,946,755

DATED : August 7, 1990

INVENTOR(S) : Sukejiro Inoue

It is certified that error appears in the above-identified patent and that said Letters Patent is hereby corrected as shown below:

COLUMN 8

Line 10, "colling," should read --cooling,--.
Line 13, "reasulting" should read --resulting--.
Line 30, "made" should read --is made--.

COLUMN 9

TABLE 2, "Example Example 2 " should read --Example 1 Example 2 --.

COLUMN 11

Line 57, "waxy material" should read --the low molecular weight polypropylene or polyethylene--.

COLUMN 12

Line 6, "mangetite" should read --magnetite--.
Line 7, "tetroxide" should read --tetraoxide--.
Line 28, "waxy material" should read --the low molecular weight polypropylene or polyethylene--.
Line 68, "waxy material" should read --the low molecular weight polypropylene or polyethylene--.

COLUMN 13

Line 6, "free" should read --free- --.
Line 10, "step" should read --steps--.

UNITED STATES PATENT AND TRADEMARK OFFICE

CERTIFICATE OF CORRECTION

PATENT NO. : 4,946,755

DATED : August 7, 1990

INVENTOR(S) : Sukejiro Inoue

It is certified that error appears in the above-identified patent and that said Letters Patent is hereby corrected as shown below:

COLUMN 14

Line 1, "40-80% weight" should read --40-80% by weight--.

Signed and Sealed this

Seventeenth Day of May, 1994

Bruce Lehman

*Attest:*

BRUCE LEHMAN

*Attesting Officer*

*Commissioner of Patents and Trademarks*